US011299311B2

(12) United States Patent
Nagaharu et al.

(10) Patent No.: US 11,299,311 B2
(45) Date of Patent: Apr. 12, 2022

(54) SYNTHETIC RESIN CONTAINER

(71) Applicant: TOYO SEIKAN CO., LTD., Tokyo (JP)

(72) Inventors: Rika Nagaharu, Yokohama (JP); Kouki Okabe, Yokohama (JP); Takeshi Uchiyama, Yokohama (JP); Ryouta Ishii, Yokohama (JP)

(73) Assignee: TOYO SEIKAN CO., LTD., Tokyo (JP)

( * ) Notice: Subject to any disclaimer, the term of this patent is extended or adjusted under 35 U.S.C. 154(b) by 0 days.

(21) Appl. No.: 16/490,991

(22) PCT Filed: Mar. 7, 2018

(86) PCT No.: PCT/JP2018/008709

§ 371 (c)(1),
(2) Date: Sep. 4, 2019

(87) PCT Pub. No.: WO2018/173748

PCT Pub. Date: Sep. 27, 2018

(65) Prior Publication Data

US 2020/0017252 A1 Jan. 16, 2020

(30) Foreign Application Priority Data

Mar. 24, 2017 (JP) ..... JP2017-058977
May 19, 2017 (JP) ..... JP2017-100337

(51) Int. Cl.
*B65D 1/46* (2006.01)
*B65D 1/02* (2006.01)

(52) U.S. Cl.
CPC ..... *B65D 1/46* (2013.01); *B65D 1/0207* (2013.01)

(58) Field of Classification Search
CPC ..... B65D 1/46; B65D 1/44; B65D 1/0223; B65D 2501/0018; B65D 2501/0036; B65D 2501/0027; B65D 79/0084
See application file for complete search history.

(56) References Cited

U.S. PATENT DOCUMENTS 6,213,326 B1 * 4/2001 Denner ..... B65D 1/0223 215/383
7,267,242 B2 9/2007 Tanaka et al.
(Continued)

FOREIGN PATENT DOCUMENTS

CN 1558854 A 12/2004
CN 103189277 B 1/2015
(Continued)

OTHER PUBLICATIONS

Observation by the Third Party filed Mar. 12, 2020 with the Japanese Patent Office in application No. 2017-058977.
(Continued)

*Primary Examiner* — Don M Anderson
(74) *Attorney, Agent, or Firm* — Sughrue Mion, PLLC

(57) ABSTRACT

A container (1) including an opening part (2), a shoulder part (3), a barrel part (4), and a bottom part (5), wherein: the shoulder part (3) includes a hem part (30) in which the longitudinal section is curved in a convex arcuate shape toward the outside of the container and which is connected to the barrel part (4); and a plurality of groove parts (31) extending radially from the container-center side toward the outer-peripheral-edge side are formed in the shoulder part (3) so as to extend at least to a position that reaches an upper end edge (UE30) of the hem part (30).

15 Claims, 11 Drawing Sheets

(56) References Cited

U.S. PATENT DOCUMENTS

| | | | | |
|---|---|---|---|---|
| 2005/0067370 | A1 | 3/2005 | Tanaka et al. | |
| 2005/0211660 | A1* | 9/2005 | Galownia | B65D 23/102 215/382 |
| 2005/0218107 | A1* | 10/2005 | Sabold | B65D 1/0223 215/382 |
| 2006/0289379 | A1* | 12/2006 | Ozawa | B65D 1/0223 215/382 |
| 2009/0101660 | A1* | 4/2009 | Matsuoka | B65D 23/102 220/608 |
| 2013/0026128 | A1* | 1/2013 | Beck | B65D 1/44 215/382 |
| 2013/0213926 | A1 | 8/2013 | Kurihara et al. | |
| 2017/0015466 | A1* | 1/2017 | Yourist | B65D 1/44 |

FOREIGN PATENT DOCUMENTS

| | | | |
|---|---|---|---|
| CN | 105008229 | A | 10/2015 |
| JP | 3050588 | U | 7/1998 |
| JP | 2000-229614 | A | 8/2000 |
| JP | 2003-72727 | A | 3/2003 |
| JP | 2003-104343 | A | 4/2003 |
| JP | 2007-76717 | A | 3/2007 |
| JP | 1362967 | S | 6/2009 |
| JP | 2009-280274 | A | 12/2009 |
| WO | 2007/032545 | A2 | 3/2007 |
| WO | 2012/043371 | A1 | 4/2012 |
| WO | 2014/101957 | A1 | 7/2014 |

OTHER PUBLICATIONS

"Suntory The European Jasmine Tea", web pages of Suntory, retrieved from URL: https://www.Suntory.co.jp/news/2011/11191.html, 2 pages (Sep. 20, 2011).

"Herbal Tea Blend Laboratory (dy64.blog94, fc2.com/)", web pages of Coca-Cola, retrieved from URL: http://dy64.blog94.fc2.com/blog-entry-469.html, 1 page (Jun. 12, 2008).

International Preliminary Report on Patentability with Translation of the Written Opinion dated Oct. 3, 2019, issued by the International Bureau in corresponding application No. PCT/JP2018/008709.

International Search Report dated Apr. 24, 2018, issued by the International Searching Authority in corresponding application No. PCT/JP2018/008709.

Communication dated Jun. 28, 2020 from the State Intellectual Property Office of the P.R.C. in Chinese Application No. 201880020465.X.

* cited by examiner

SYNTHETIC RESIN CONTAINER

CROSS REFERENCE TO RELATED APPLICATIONS

This application is a National Stage of International Application No. PCT/JP2018/008709 filed Mar. 7, 2018, claiming priority based on Japanese Patent Application No. 2017-058977 filed Mar. 24, 2017 and Japanese Patent Application No. 2017-100337 filed May 19, 2017.

TECHNICAL FIELD

The present invention relates to a synthetic resin container having improved impact resistance of a shoulder part of the container to impact from a horizontal direction.

BACKGROUND ART

A synthetic resin container formed by using a thermoplastic resin such as polyethylene terephthalate to prepare a closed-end cylindrical preform by injection molding, compression molding or the like, and molding this preform into a bottle shape by biaxial stretching blow molding has been used so far as a container in which various beverages, various seasonings and the like are filled as a content liquid in the wide range of fields.

In a synthetic resin container of this kind, an attempt to mold the container into a wall as thin as possible has been made in order to reduce weight of the container or reduce cost by reduction of an amount of a resin to be used. In recent years, a demand for such wall-thinning has been increasingly becoming stringent, and as the wall-thinning is achieved, rigidity of the container is reduced, and the container is depressed by impact to be applied from outside or the like, whereby poor appearance is easily caused by deformation of a container shape into an indefinite shape.

Under such a situation, for example, Patent Document 1 describes that a container has a wall surface formed of a plurality of curved surfaces in a shoulder part, whereby a tangent of each curved surface plays a role of a longitudinal rib, and even when a thin-walled bottle is formed, strength of the shoulder part can be maintained.

RELATED ART DOCUMENTS

Patent Documents

Patent Document 1: JP-A-2003-104343

SUMMARY OF THE INVENTION

Problems to be Solved by the Invention

Meanwhile, when a content liquid is filled in a molded container, for example, air is blown to the container hung on a guide rail to convey the container in a sliding manner with a forward-tilting posture in several cases. In this case, the container conveyed later collides with the container previously conveyed and waiting, and stops. On the occasion, impact from a horizontal direction is applied to a shoulder part of the container (see FIG. 13).

Moreover, when the containers filled with beverages or the like are packed in a box and loaded on a cargo bed of a truck or the like to transport the containers, the impact from the horizontal direction is also applied to the shoulder part of the container by collision of the containers adjacent to each other in the box by vibration thereof.

Sufficient impact resistance is not obtained to such impact from the horizontal direction only by having the wall surface formed of the plurality of curved surfaces in the shoulder part as described in Patent Document 1, and in further achieving the wall-thinning, there has been room for improvement for suppressing depression of the shoulder part of the container by the impact from the horizontal direction.

The present invention has been made in view of such a situation as described above, and an object of the present invention is to provide a synthetic resin container having improved impact resistance of a shoulder part of the container to impact from a horizontal direction.

Means for Solving the Problems

A container according to the present invention has a configuration, comprising an opening part, a shoulder part, a barrel part and a bottom part, wherein: the shoulder part includes a hem part which is curved in a convex arcuate shape toward the outside of the container in a longitudinal section, and is connected to the barrel part; and a plurality of groove parts extending radially from a container-center side toward an outer-peripheral-edge side are formed in the shoulder part so as to extend to at least a position that reaches an upper end edge of the hem part.

Advantageous Effects of the Invention

According to the present invention, even if impact from a horizontal direction is applied to a shoulder part of a container, the shoulder part of the container is not depressed, and deformation of the container can be suppressed.

MODE FOR CARRYING OUT THE INVENTION

Figure 1:
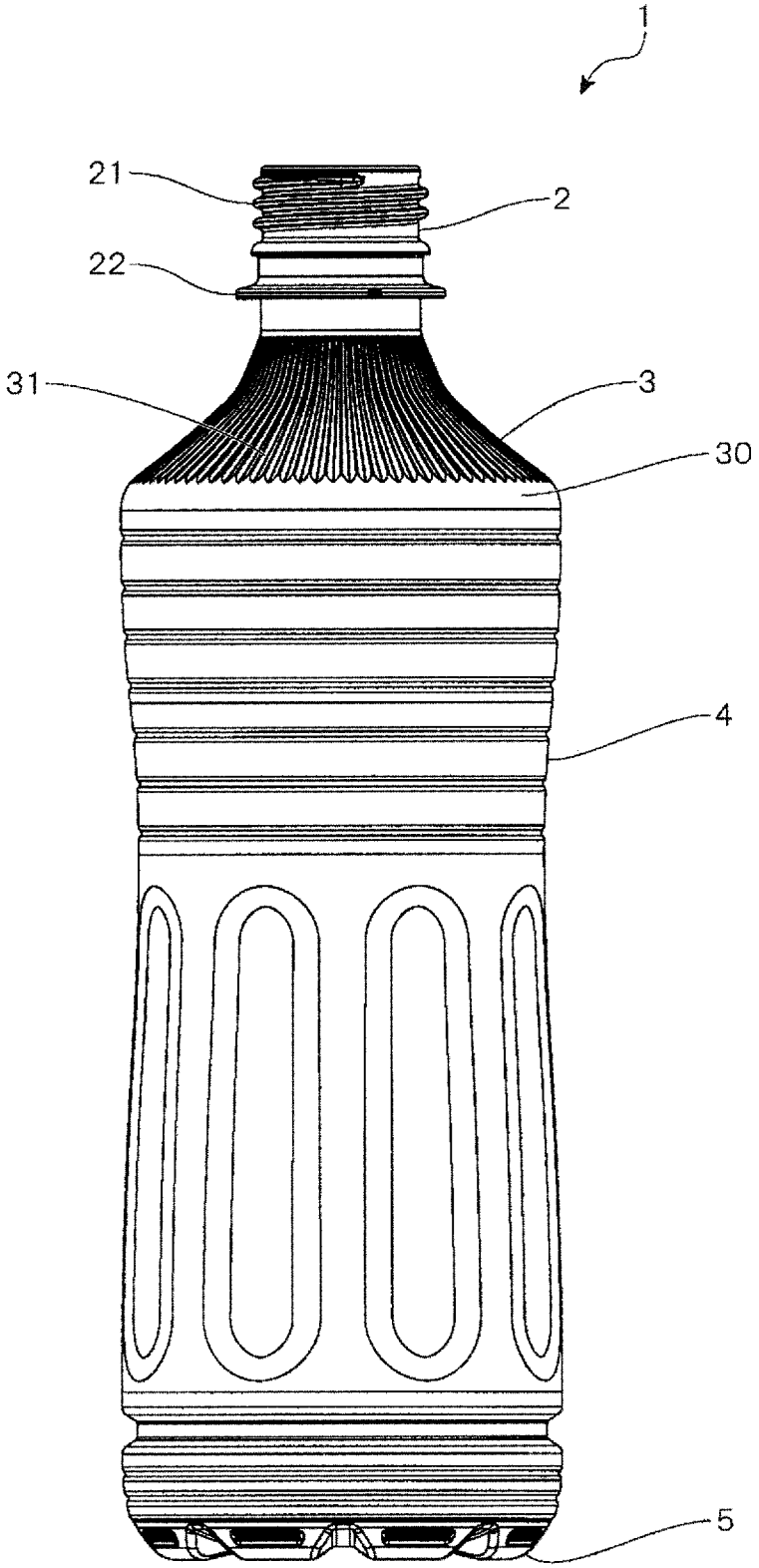
FIG. 1 is a front view schematically showing a first embodiment of a synthetic resin container according to the present invention.

Hereinafter, preferable embodiments of the present invention will be described with reference to drawings.

First Embodiment

First, a first embodiment of the present invention will be described.

A container 1 according to the present invention comprises an opening part 2, a shoulder part 3, a barrel part 4 and a bottom part 5, and the container 1 illustrated as the first embodiment of the present invention has a container shape generally called a round bottle in which the barrel part 4 is formed in a cylindrical shape.

Figure 2:
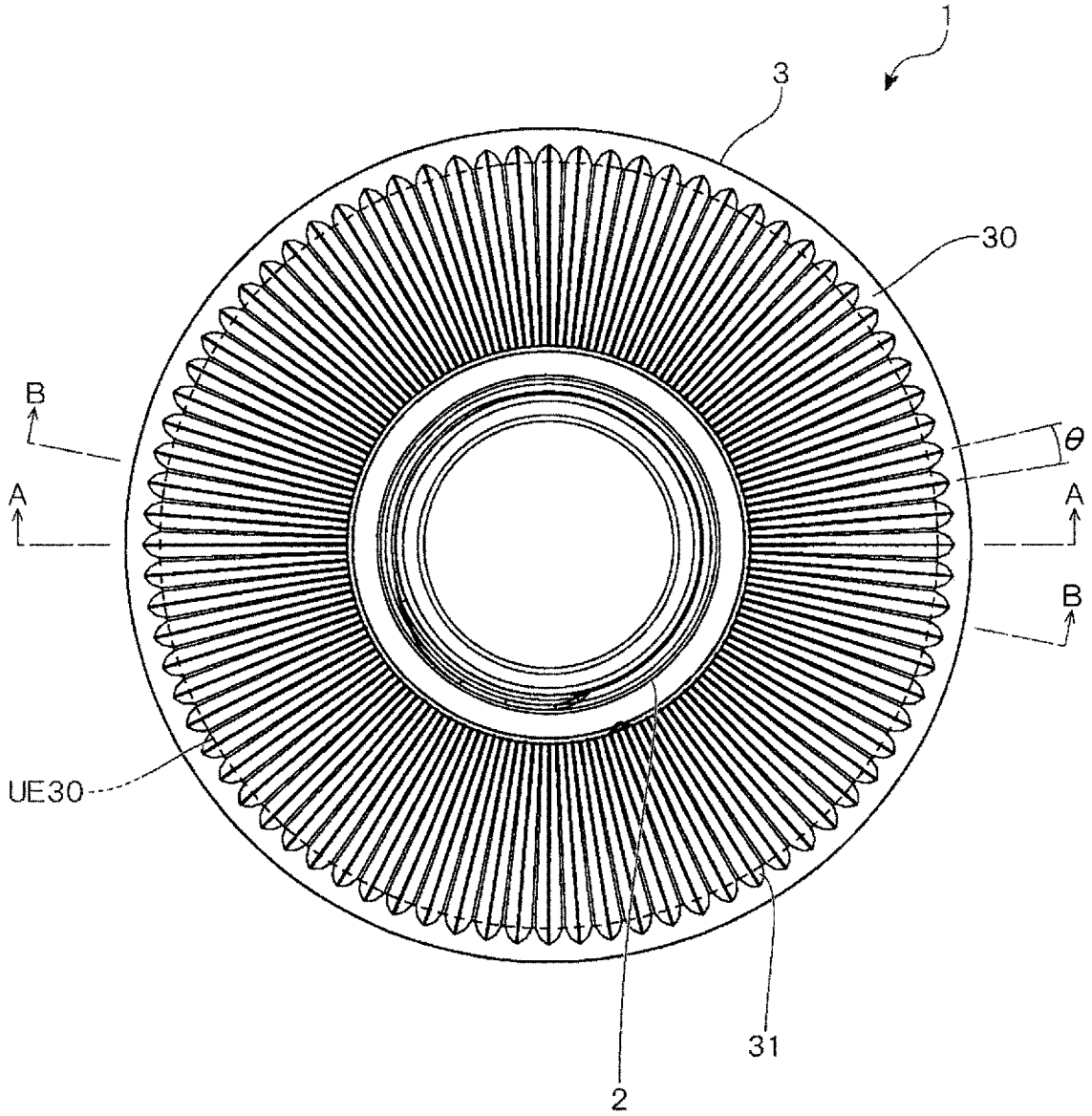
FIG. 2 is a plan view schematically showing the first embodiment of the synthetic resin container according to the present invention.

It should be noted that FIG. 1 is a front view schematically showing the container 1 according to the present embodiment, and FIG. 2 is a plan view schematically showing the same.

Here, in the present invention, when the container 1 is erected on a horizontal surface with the opening part 2 upward, a direction perpendicular to the horizontal surface is to be referred to as a height direction to specify up and down, right and left, and lengthwise and crosswise directions of the container 1 in this state.

The container 1 is produced by using a thermoplastic resin to mold a closed-end cylindrical preform by injection molding, compression molding or the like, and molding the preform into a predetermined container shape by biaxial stretching blow molding or the like.

In producing the container 1, as the thermoplastic resin to be used, an arbitrary blow-moldable resin can be used. Specifically, such a material is preferable as thermoplastic polyester including polyethylene terephthalate, polybutylene terephthalate, polyethylene naphthalate, amorphous polyarylate, polylactic acid or a copolymer thereof, and a material prepared by blending these resins or these resins with other resins. In particular, ethylene terephthalate-based thermoplastic polyester such as polyethylene terephthalate is preferably used. Moreover, polycarbonate, an acrylonitrile resin, polypropylene, a propylene-ethylene copolymer, polyethylene or the like can also be used.

The opening part 2 is a cylindrical site serving as an inlet or outlet of a content liquid. A thread 21 for attaching a lid (not shown) to the container is provided on a side surface on an opening end side of such an opening part 2, and a neck ring 22 annularly protruding along a peripheral direction is provided below the thread. Then, a part including a part cylindrically drooping at substantially the same diameter from directly beneath the neck ring 22 is to be referred to as the opening part 2.

Figure 3:
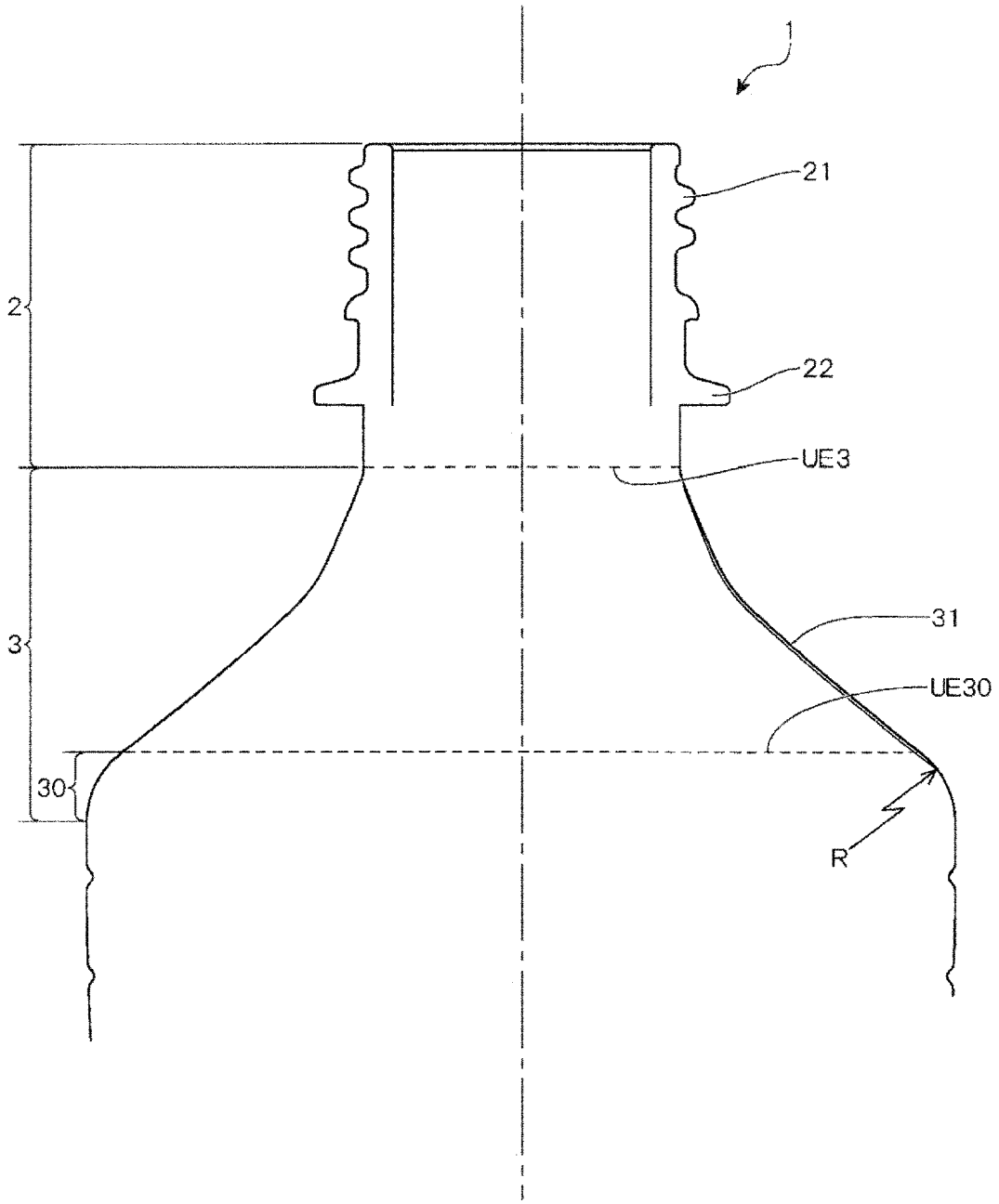
FIG. 3 is a substantial part cross sectional view of the first embodiment shown in FIG. 2.

The shoulder part 3 is a site which is connected to a lower end of the opening part 2, and is diameter-expanded toward the barrel part 4 to connect parts between the opening part 2 and the barrel part 4, and a position starting to be diameter-expanded toward the barrel part 4 is taken as a an upper end edge UE3 of the shoulder part 3, which is shown by a dotted line in FIG. 3.

Moreover, the shoulder part 3 includes, on a lower end side thereof, a hem part 30 which is curved in a convex arcuate shape toward the outside of the container in a longitudinal section, and is connected to the barrel part 4, and is continued to the hem part 30 while being gradually diameter-expanded toward the barrel part 4.

It should be noted that FIG. 3 is a substantial part cross sectional view of the container 1 shown in FIG. 2, in which a substantial part of a cross section taken along a line A-A of FIG. 2 is shown on a right side in the figure, and a substantial part of a cross section taken along a line B-B of FIG. 2 is shown on a left side in the figure, and a wall thickness of a site positioned on a lower side of the neck ring 22 is omitted in FIG. 3.

In the present embodiment, the shoulder part 3 is generally formed in a truncated cone shape. Then, the shoulder part is continued to the hem part 30 while being diameter-expanded to be changed in an inclination of a generatrix of the shoulder part on the way, but may be configured to be continued to the hem part 30 while being diameter-expanded without recognizing a remarkable change in the inclination of the generatrix. Further, the shoulder part may be continued to the hem part 30 while being diameter-expanded to from a linear shape in the generatrix, or may be continued to the hem part 30 while being diameter-expanded to draws a gentle arc in the generatrix. However, in at least a site immediately before the part continued to the hem part 30, an inclination angle (angle with respect to the horizontal surface on which the container 1 is erected) of the site is preferably in the range of 40° to 55°.

Moreover, the hem part 30 is preferably formed to be substantially constant in a curvature radius R of the longitudinal section, and a position from which the longitudinal section of the shoulder part 3 starts to be curved with the curvature radius R of the longitudinal section of the hem part 30 is taken as an upper end edge UE30 of the hem part 30, which is shown by a dotted line in FIG. 2 and FIG. 3. The curvature radius R of the longitudinal section of the hem part 30 is preferably adjusted to 4 mm to 10 mm in improving impact resistance of the shoulder part 3 to impact from the horizontal direction, and in the present embodiment, the curvature radius R of the longitudinal section of the hem part 30 is adjusted to 7 mm.

The barrel part 4 is a site occupying most of the container 1 in the height direction, and a lower end thereof is connected to the bottom part 5. A specific form of the barrel part 4 and the bottom part 5 is not particularly limited, and therefore a detail description thereof is omitted.

In the present embodiment, a plurality of groove parts 31 extending radially from a container-center side toward an outer-peripheral-edge side are formed in the shoulder part 3, and each groove part 31 is formed so as to extend on a surface of the shoulder part 3 with a position close to the upper end edge UE3 of the shoulder part 3 as a starting end. The starting end of the groove part 31 is positioned above the shoulder part 3, whereby longitudinal compression strength of the shoulder part 3 can be improved, and if a part serving as a starting point of deformation by longitudinal compression can be reinforced, the position of the starting end of the groove part 31 is not particularly limited.

Moreover, in the present embodiment, a terminating end of the groove part 31 is located in a position projected over the upper end edge UE30 of the hem part 30. Then, each groove part 31 is preferably formed so as to extend, to such a position, along the inclination of the site immediately before the part is continued to the hem part 30 and to be projected from the upper end edge UE30 of the hem part 30, but the groove part 31 formed in the shoulder part 3 only needs to be formed so as to extend to at least a position that reaches the upper end edge UE30 of the hem part 30.

It should be noted that, when the terminating end of the groove part 31 is over the upper end edge UE30 of the hem part 30, the terminating end is preferably located in the range without passing over the outer-peripheral edge of the hem part 30 for preventing the deformation such as bending of the groove part 31 caused by directly receiving the impact.

Thus, when the impact from the horizontal direction is applied to the shoulder part 3, the impact resistance of the shoulder part 3 to the impact from the horizontal direction can be improved by a synergistic effect by action of the groove part 31 formed in the shoulder part 3 to suppress the deformation by the impact, and simultaneously by formation of the longitudinal section of the hem part 30 so as to be curved in the convex arcuate shape toward the outside of the container. Thus, even if the impact from the horizontal direction is applied to the shoulder part 3, the shoulder part 3 is not depressed, and the deformation of the shoulder part 3 can be suppressed.

In view of allowing such an effect to be more effectively produced, in order to secure sufficient strength to the impact in, a groove width w of the groove part 31 is preferably 1.5 mm to 2.5 mm on a terminating end side thereof, and a groove depth d of the groove part 31 is preferably 0.25 mm to 0.65 mm on the terminating end side.

Figure 4:
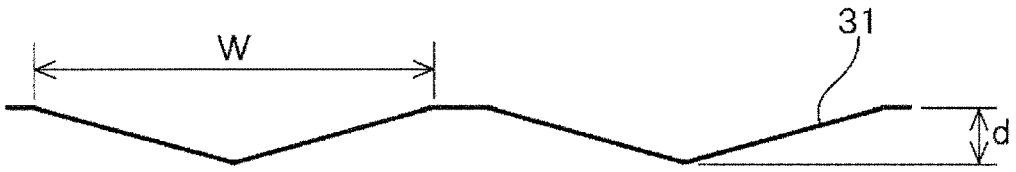
FIG. 4 is an explanatory diagram showing a cross section perpendicular to an extending direction of a groove part in the first embodiment of the synthetic resin container according to the present invention.

Moreover, a cross section perpendicular to an extending direction of the groove part 31 is shown in FIG. 4. In the groove part 31, as shown in the figure, the cross section perpendicular to the extending direction of the groove part may be formed in a V-shape, and when necessary, the cross section may be formed in a U-shape, a channel-shape or the like.

In radially forming the plurality of groove parts 31 in the shoulder part 3, with regard to an interval of the groove parts 31 adjacent to each other in the peripheral direction, the groove parts 31 are preferably provided densely in the range in which shapability is not adversely affected, and in examples shown in FIG. 1 and FIG. 2, an angle θ formed between center lines of the groove parts 31 adjacent to each other in the peripheral direction is adjusted to about 4.5°, and the groove parts 31 are formed to be densely adjacent to each other.

Figure 5:
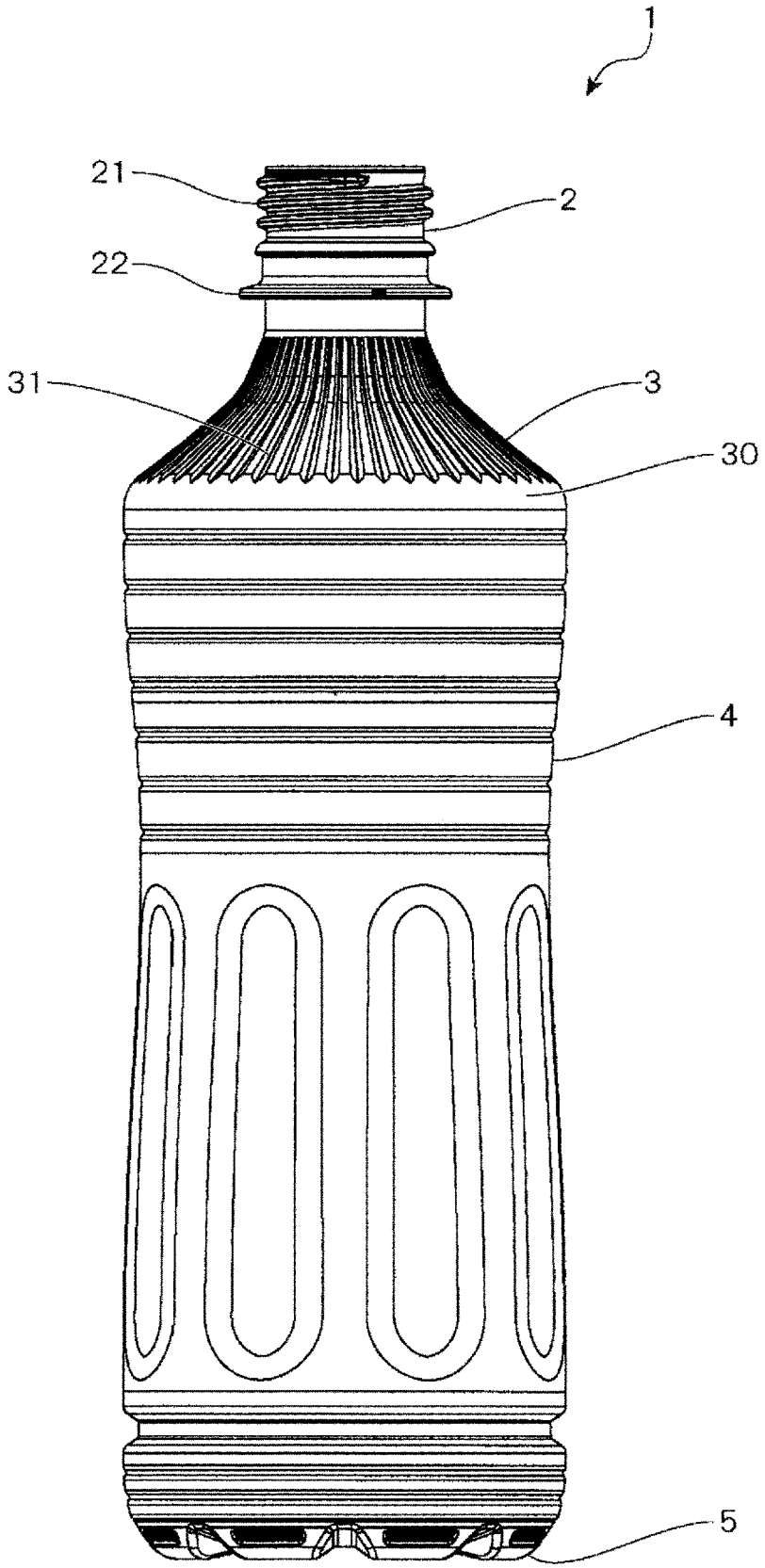
FIG. 5 is a front view schematically showing a modified example of the first embodiment of the synthetic resin container according to the present invention.
Figure 6:
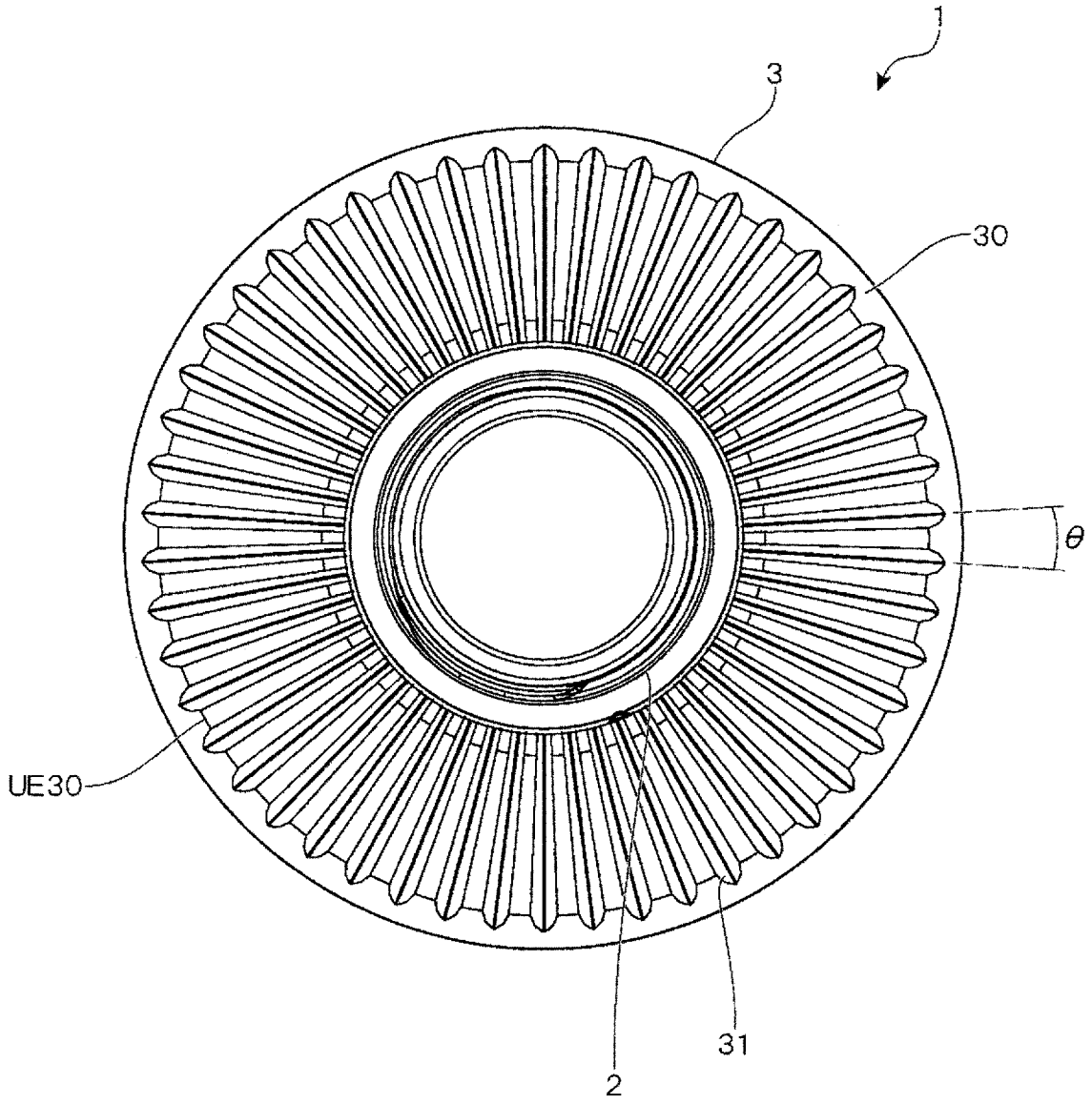
FIG. 6 is a plan view schematically showing the modified example of the first embodiment of the synthetic resin container according to the present invention.

Moreover, the groove parts 31 can also be formed at a predetermined interval in the peripheral direction, and in examples shown in FIG. 5 and FIG. 6, the angle θ formed between the center lines of the groove parts 31 adjacent to each other in the peripheral direction is adjusted to about 7.2°, but the groove parts 31 adjacent to each other in the peripheral direction are preferably formed at such an interval at which at least two groove parts 31 exist in the range in which the impact from the horizontal direction is received in a concentrated manner.

Figure 7:
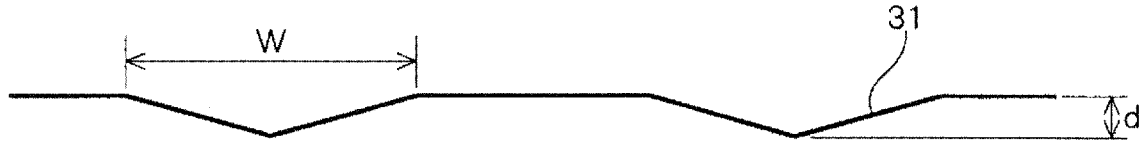
FIG. 7 is an explanatory diagram showing a cross section perpendicular to the extending direction of the groove part in the modified example of the first embodiment of the synthetic resin container according to the present invention.

It should be noted that FIG. 5 is a front view schematically showing a container 1 according to a modified example of the present embodiment, and FIG. 6 is a plan view schematically showing the same. Moreover, FIG. 7 is an explanatory diagram showing a cross section perpendicular to an extending direction of the groove part 31 in the present modified example.

For example, in the present embodiment, if capacity in the container is 500 mL, a peripheral length of a maximum outside diameter part of the shoulder part 3 is about 217 mm, and if a length along the peripheral direction for a site in which the impact from the horizontal direction is received in the concentrated manner is about 24 mm, a central angle of the site is about 40°.

When these are taken into account, the angle θ formed between the center lines of the groove parts 31 adjacent to each other in the peripheral direction is preferably 2.5° to 20°.

Moreover, in radially forming the plurality of groove parts 31, in the present embodiment, each groove part 31 is formed at an equal angle interval, but the intervals may be made different when necessary. In this case, the intervals of the groove parts 31 adjacent to each other in the peripheral direction may be alternately configured to be sparse and dense along the peripheral direction, or a part in which several groove parts 31 are densely formed and a part in which several groove parts 31 are sparsely formed may be mixed. Further, the angle θ formed between the center lines of the groove parts 31 adjacent to each other in the peripheral direction may be periodically changed along the peripheral direction, but in any aspects, in consideration of a balance with an overall shape of the container 1, the angle θ formed between the center lines of the groove parts 31 adjacent to each other in the peripheral direction is preferably appropriately adjusted within the range described above so that the groove parts 31 may be formed in rotationally symmetrical arrangement with a center of the container as a symmetrical axis.

Second Embodiment

Next, a second embodiment of the present invention will be described.

Figure 8A:
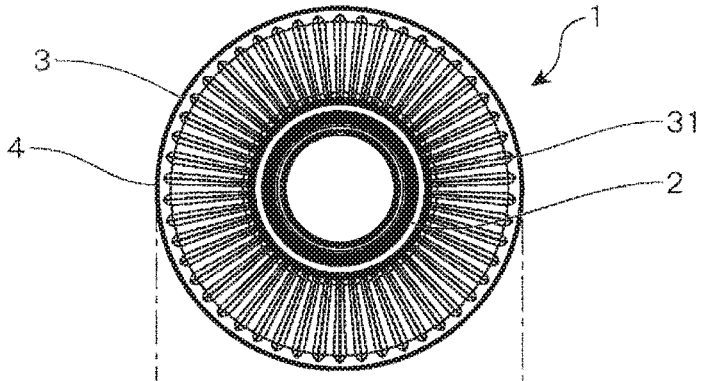
FIGS. 8A and 8B are a plan view and a front view, respectively, schematically showing a second embodiment of the synthetic resin container according to the present invention.
Figure 8B:
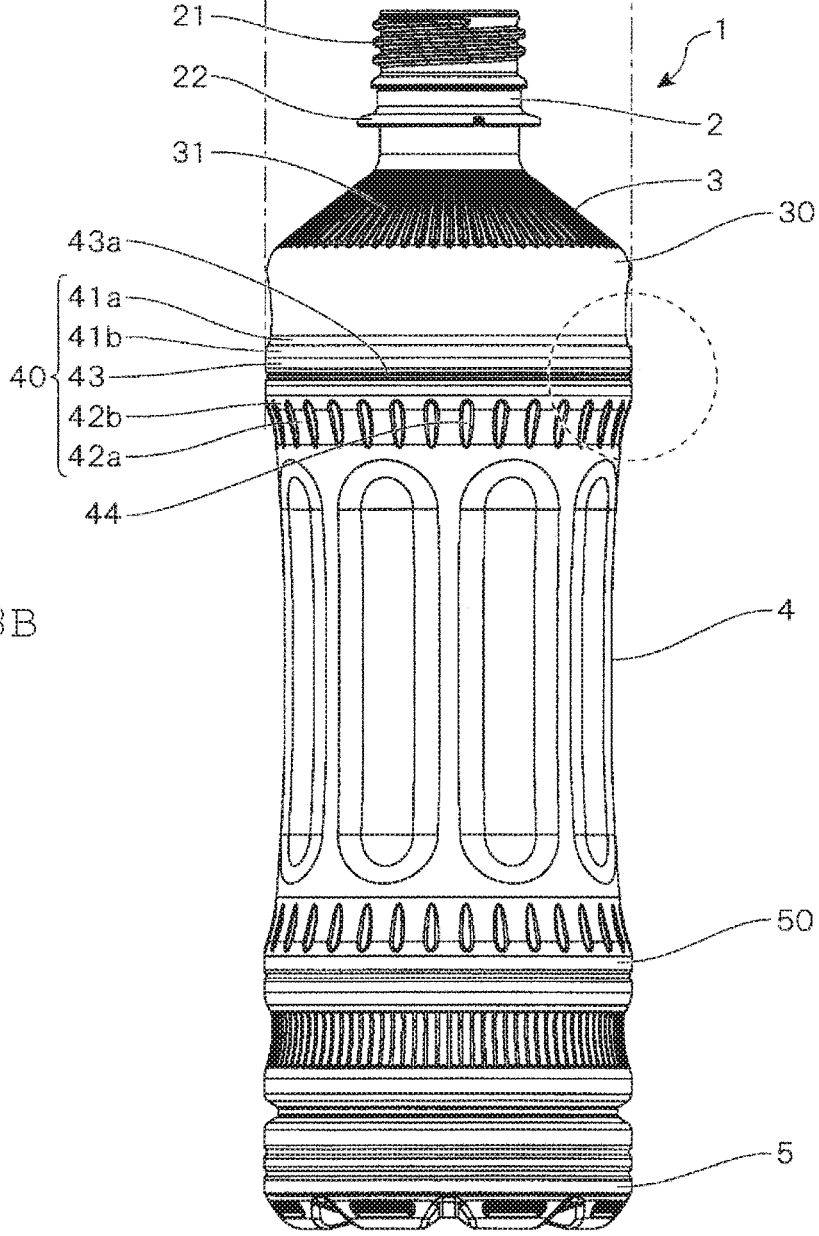
Figure 9:
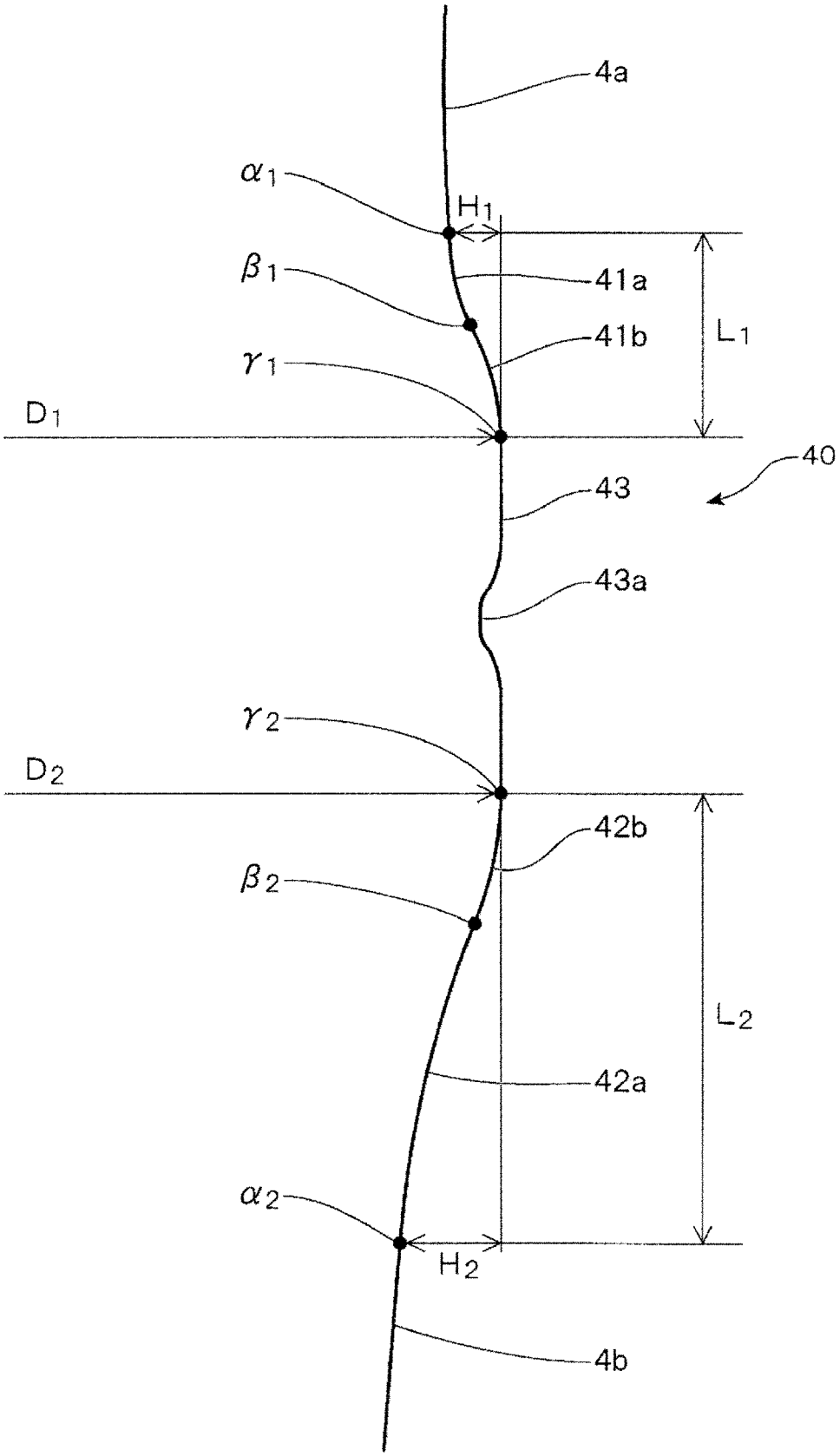
FIG. 9 is an explanatory diagram showing a substantial part longitudinal section of FIG. 8B.

FIG. 8A is a plan view schematically showing a synthetic resin container according to the present embodiment, and FIG. 8B is a front view schematically showing the same. Moreover, FIG. 9 is an explanatory diagram showing a longitudinal section of a part surrounded by a dotted line in FIG. 8B, and a wall thickness of the longitudinal section is omitted in FIG. 9.

In the same manner as in the first embodiment, a container 1 shown as the second embodiment of the present invention has an opening part 2, a shoulder part 3, a barrel part 4 and a bottom part 5, and has a container shape generally called a round bottle in which the barrel part 4 is formed in a cylindrical shape.

The shoulder part 3 is a site connected to a lower end of the opening part 2 and diameter-expanded toward the barrel part 4 to connect parts between the opening part 2 and the barrel part 4. The shoulder part 3 is formed in the same manner as in the first embodiment, whereby even if the impact from the horizontal direction is applied to the shoulder part 3, the shoulder part 3 is not depressed, and the deformation of the shoulder part 3 can be suppressed.

It should be noted that an overlapping description is omitted on a configuration common to the configuration in the first embodiment.

Moreover, the barrel part 4 is a site occupying most of the container 1 in a height direction, and an upper end thereof is connected to the shoulder part 3 and a lower end thereof is connected to the bottom part 5. Then, the barrel part 4 has an annular raised part 40 extending along a peripheral direction in a position near the upper end thereof.

The annular raised part 40 is formed, in which a peripheral surface of the barrel part 4 is annularly raised, and an upper edge side thereof is raised through an upper edge side first curved part 41*a* formed in a convex arcuate shape toward the inside of the container in a longitudinal section, and an upper edge side second curved part 41*b* formed in the convex arcuate shape toward the outside of the container in the longitudinal section. On the other hand, a lower edge side of the annular raised part 40 is raised through a lower edge side first curved part 42*a* formed in the convex arcuate shape toward the inside of the container in the longitudinal section, and a lower edge side second curved part 42*b* formed in the convex arcuate shape toward the outside of the container in the longitudinal section.

It should be noted that, in FIG. 9, a raised starting end of the upper edge side first curved part 41*a* is shown by a point $\alpha_1$, a connecting part between the upper edge side first curved part 41*a* and the upper edge side second curved part 41*b* is shown by a point $\beta_1$, a raised terminating end of the upper edge side second curved part 41*b* is shown by a point $\gamma_1$, a raised starting end of the lower edge side first curved part 42*a* is shown by a point $\alpha_2$, a connecting part between the lower edge side first curved part 42*a* and the lower edge side second curved part 42*b* is shown by a point $\beta_2$, and a raised terminating end of the lower edge side second curved part 42*b* is shown by a point $\gamma_2$.

According to the present embodiment, if a load is applied to such an annular raised part 40, a site to which the load is applied is deformed so as to be forced toward the inside of the container, and on the occasion, the upper edge side and the lower edge side of the annular raised part 40 are deformed so as to be deflected together with peripheral sites connected thereto, whereby the load is dispersed. Thus, the annular raised part 40 can be suppressed from being collapsed, and simultaneously the deformed site exerts restoring force for attempting to return to an original shape if the load is eliminated.

As a result, for example, when the containers 1 filled with a content liquid are packed in a box and loaded on a cargo bed of a truck or the like to transport the containers 1, the load from the horizontal direction is applied to the containers 1 by pushing or collision of the containers 1 adjacent to each other in the box by vibration thereof. The container is restored to the original shape after the deformation while allowing the deformation to such a load from outside, whereby indefinite permanent deformation of the barrel part 4 can be suppressed.

It should be noted that, in Patent Document 1, on a boundary between a shoulder part of a container and a barrel part of the container, an annular convex part which surrounds the barrel part of the container, and is projected from a surface thereof is provided, and annular narrow grooves along the annular convex part are arranged on both sides of this annular convex part, whereby strength is improved. However, the art is not configured in such a manner that the deformation by the load to be applied from outside is allowed, whereby a deformed container can be restored to the original shape. Therefore, when the load more than or equal to an assumed level is applied, indefinite permanent deformation of the container shape has been unavoidable, and a demand for further wall-thinning has been unable to be responded.

In allowing such an effect to more favorably to produce, it is preferable that the site to which the load is applied can be reasonably deformed and favorably restored to the original shape.

In order to achieve the purpose, the upper edge side first curved part 41*a* and the lower edge side first curved part 42*a* serving as a starting end side raised from the peripheral surface of the barrel part 4 are preferably formed in an arcuate shape having a curvature radius of 3 to 90 mm in longitudinal sections thereof. Then, the upper edge side second curved part 41*b* and the lower edge side second curved part 42*b* are preferably formed in an arcuate shape having a curvature radius of 3 to 90 mm in longitudinal sections thereof to be smoothly connected to the upper edge side first curved part 41*a* and the lower edge side first curved part 42*a*, respectively.

Further, on the upper edge side of the annular raised part 40, a raised height (separation distance between the raised starting end $\alpha_1$ of the upper edge side first curved part 41*a* and the raised terminating end $\gamma_1$ of the upper edge side second curved part 41*b* along a direction perpendicular to the height direction) $H_1$ is preferably 0.5 to 5% of a container barrel diameter $D_1$ in the raised terminating end $\gamma_1$ of the upper edge side second curved part 41*b*. A raised length (separation distance between the raised starting end $\alpha_1$ of the upper edge side first curved part 41*a* and the raised terminating end $\gamma_1$ of the upper edge side second curved part 41*b* along the height direction) $L_1$ is preferably 3 to 18 mm, and more preferably 3 to 8 mm.

On the other hand, on the lower edge side of the annular raised part 40, a raised height (separation distance between the raised starting end $\alpha_2$ of the lower edge side first curved part 42*a* and the raised terminating end $\gamma_2$ of the lower edge side second curved part 42*b* along a direction perpendicular to the height direction) $H_2$ is preferably 0.5 to 5% of a container barrel diameter $D_2$ in the raised terminating end $\gamma_2$ of the lower edge side second curved part 42*b*. A raised length (separation distance between the raised starting end $\alpha_2$ of the lower edge side first curved part 42*a* and the raised terminating end $\gamma_2$ of the lower edge side second curved part 42*b* along the height direction) $L_2$ is preferably 3 to 18 mm, and more preferably 5 to 18 mm.

Moreover, a longitudinal section shape of the barrel part 4 is preferably formed in the convex arcuate shape toward the inside of the container in sites 4*a* and 4*b* connected to at least the annular raised part 40 (see FIG. 9) so that a peripheral site connected to the annular raised part 40 may be reasonably deformed together with the annular raised part 40. In this case, it is preferable that the sites 4*a* and 4*b* are formed, in longitudinal sections thereof, in an arcuate shape having a curvature radius larger than in longitudinal sections of the upper edge side first curved part 41*a* and the lower edge side first curved part 42*a* connected thereto, whereby the sites 4*a* and 4*b* are smoothly connected to the upper edge side first curved part 41*a* and the lower edge side first curved part 42*a*.

It should be noted that, unless the deformation of the peripheral site connected to the annular raised part 40 is inhibited, the longitudinal sections of the sites 4*a* and 4*b* may be formed in a linear shape.

Moreover, the annular raised part 40 is preferably formed so that a diameter of a site provided with the annular raised part 40 may be equal to or approximated to a maximum outside diameter $D_{MAX}$ of the container 1 so as to easily receive the load from outside by the annular raised part 40. A position in which the annular raised part 40 is provided is not particularly limited. However, for example, when the container 1 is filled with the content liquid, a center of gravity is on an upper side of a center in the height direction. Therefore, if such a state is considered, in which the containers 1 packed in the box are pushed or collided with each other by significant swinging of parts on the upper side by vibration upon transportation, the annular raised part 40 is preferably provided in a position near an upper end of the barrel part 4.

Accordingly, in the present embodiment, the annular raised part 40 is provided in the position near the upper end of the barrel part 4, and simultaneously a second annular ridge 50 is provided in a position near a lower end of the barrel part 4, and also in such a second annular ridge 50, all the above-described requirements specifying the annular raised part 40 provided in the position near the upper end of the barrel part 4 are preferably satisfied, but such satisfaction is not necessarily required.

Moreover, in the present embodiment, the annular raised part 40 includes a top surface part 43 formed in the linear shape in the longitudinal section (preferably, the linear shape in parallel to a center axis of the container 1), whereby the load applied to the annular raised part 40 is configured to be received on a surface. Thus, local concentration of the load from outside is avoided, whereby the container is configured to be able to more effectively suppress the annular raised part 40 from being collapsed, but the top surface part 43 may be omitted when necessary (see FIG. 10).

When the annular raised part 40 includes the top surface part 43 formed in the linear shape in the longitudinal section, an annular groove 43*a* can be formed in such a top surface part 43 at a depth not more than either the raised height H1 or H2 of the annular raised part 40 (see FIG. 9). Such an annular groove 43*a* is formed, whereby load withstand performance of the top surface part 43 can be improved, and a plurality of the annular grooves 43*a* may be formed, or may be omitted when necessary (see FIG. 11).

Moreover, in the present embodiment, on the lower edge side of the annular raised part 40, a plurality of longitudinal ribs 44, that one end thereof is projected into the lower edge side second curved part 42*b* over a connected part of the lower edge side first curved part 42*a* and the lower edge side second curved part 42*b*, are lined up along an extending direction of the annular raised part 40. Such longitudinal ribs 44 are lined up along the extending direction of the annular raised part 40, whereby the restoring force in the site deformed by the load applied to the annular raised part 40 can be improved.

When the longitudinal ribs 44 are lined up along the extending direction of the annular raised part 40, for example, the longitudinal ribs 44 can be formed in a concave groove shape having a depth of 0.3 to 0.8 mm and a length of 8 to 11 mm, and in an example shown in the figure, 24 pieces of longitudinal ribs 44 are lined up, but the configuration is not limited thereto. Although not particularly shown, in place of lining up the longitudinal ribs 44 on the lower edge side of the annular raised part 40, or together with the longitudinal ribs 44 lined up on the lower edge side of the annular raised part 40, a plurality of longitudinal ribs, that one end thereof is projected into the upper edge side second curved part 41*b* over the connected part of the upper edge side first curved part 41*a* and the upper edge side second curved part 41*b*, may be lined up along the extending direction of the annular raised part 40 on the upper edge side of the annular raised part 40.

Figure 10:
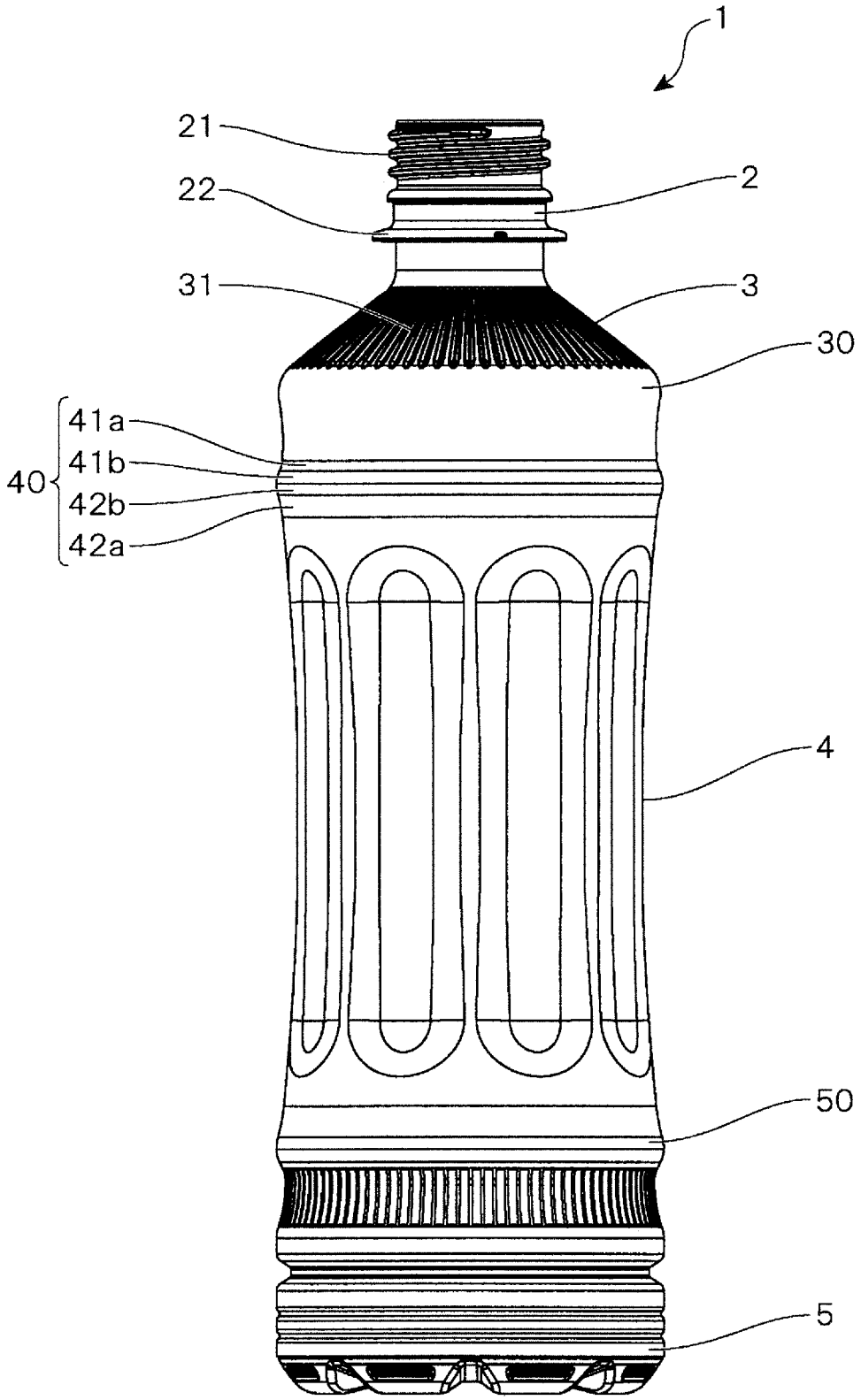
FIG. 10 is a front view schematically showing a modified example of the second embodiment of the synthetic resin container according to the present invention.
Figure 11:
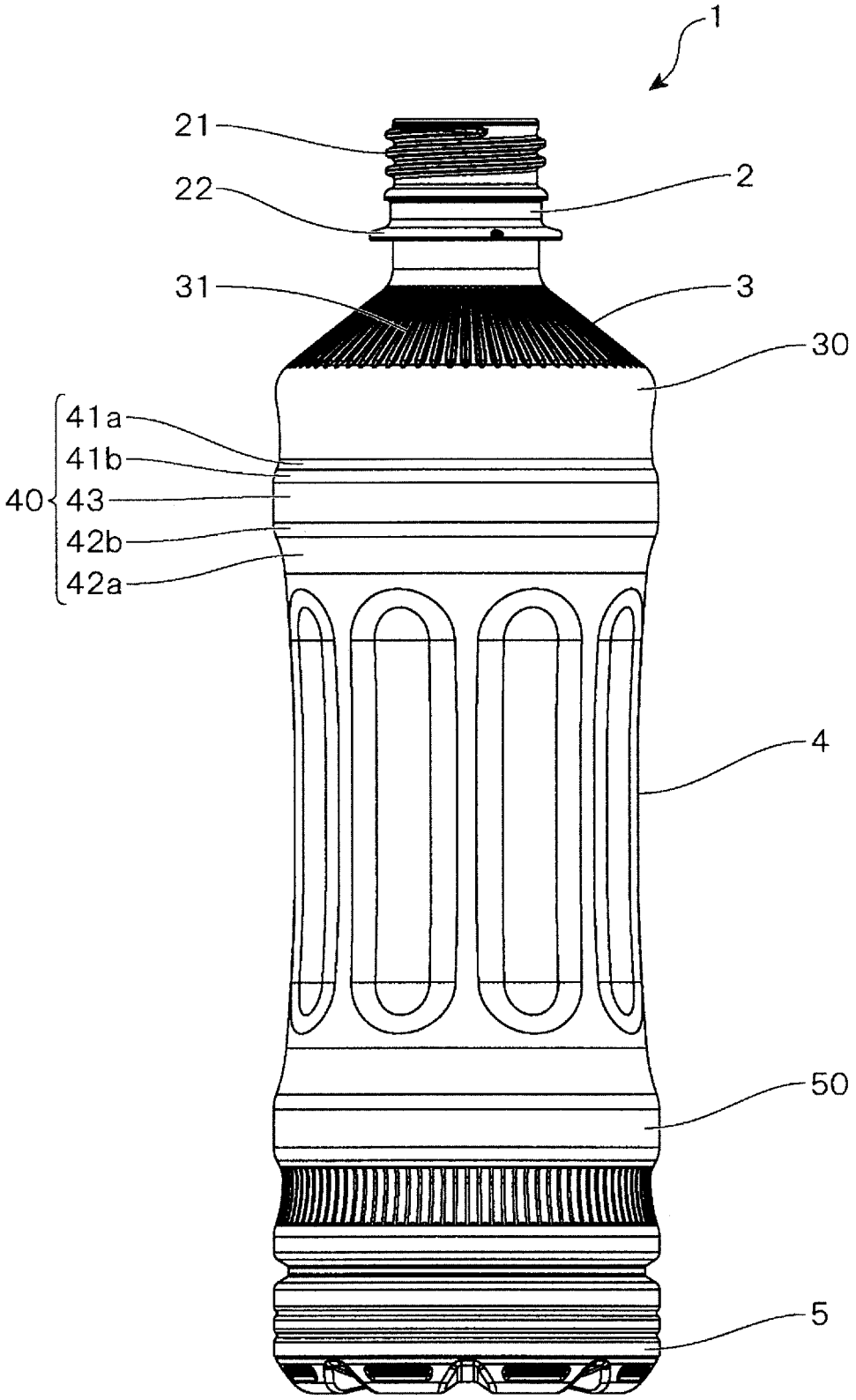
FIG. 11 is a front view schematically showing another modified example of the second embodiment of the synthetic resin container according to the present invention.
Figure 12:
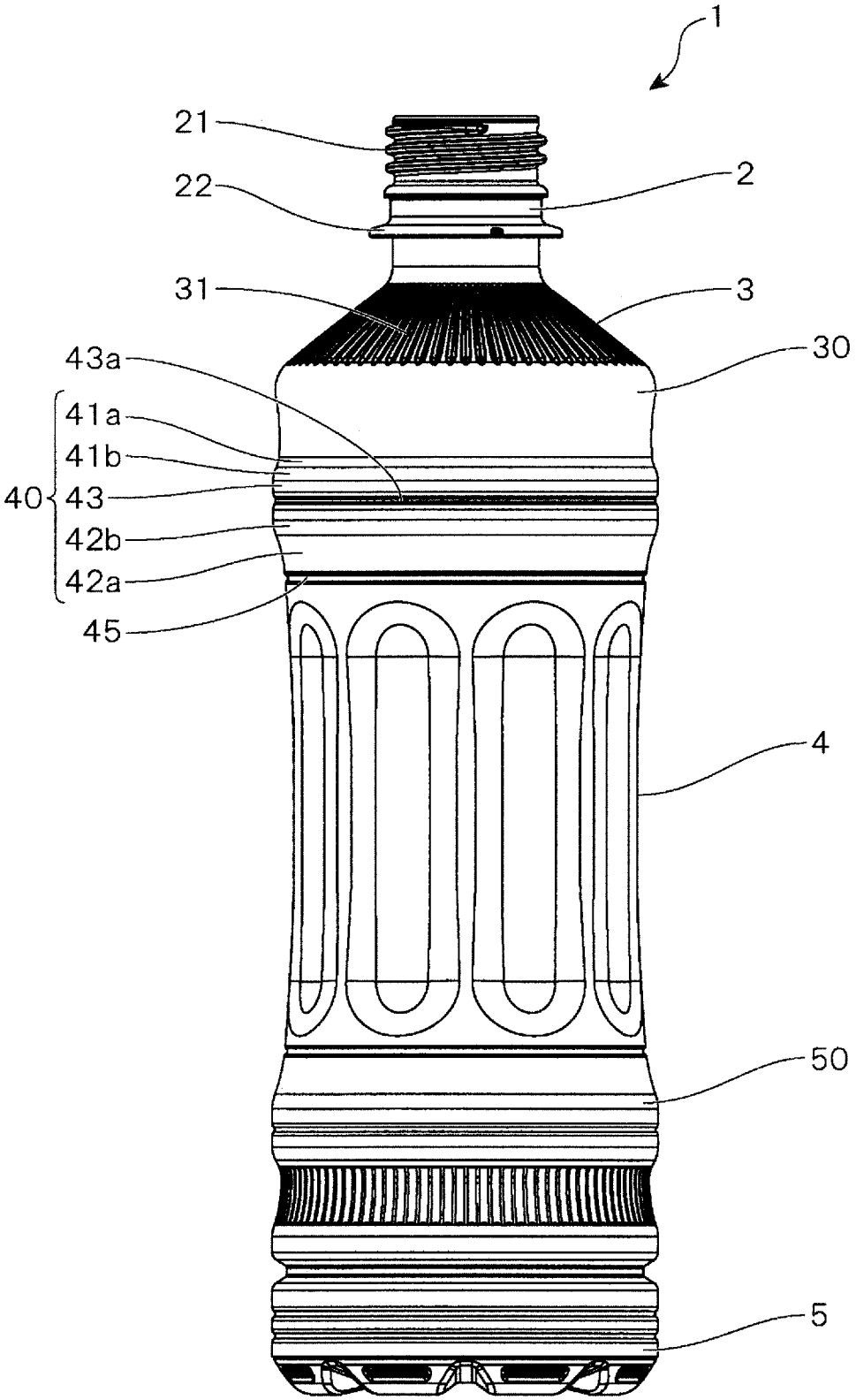
FIG. 12 is a front view schematically showing another modified example of the second embodiment of the synthetic resin container according to the present invention.
Figure 13:
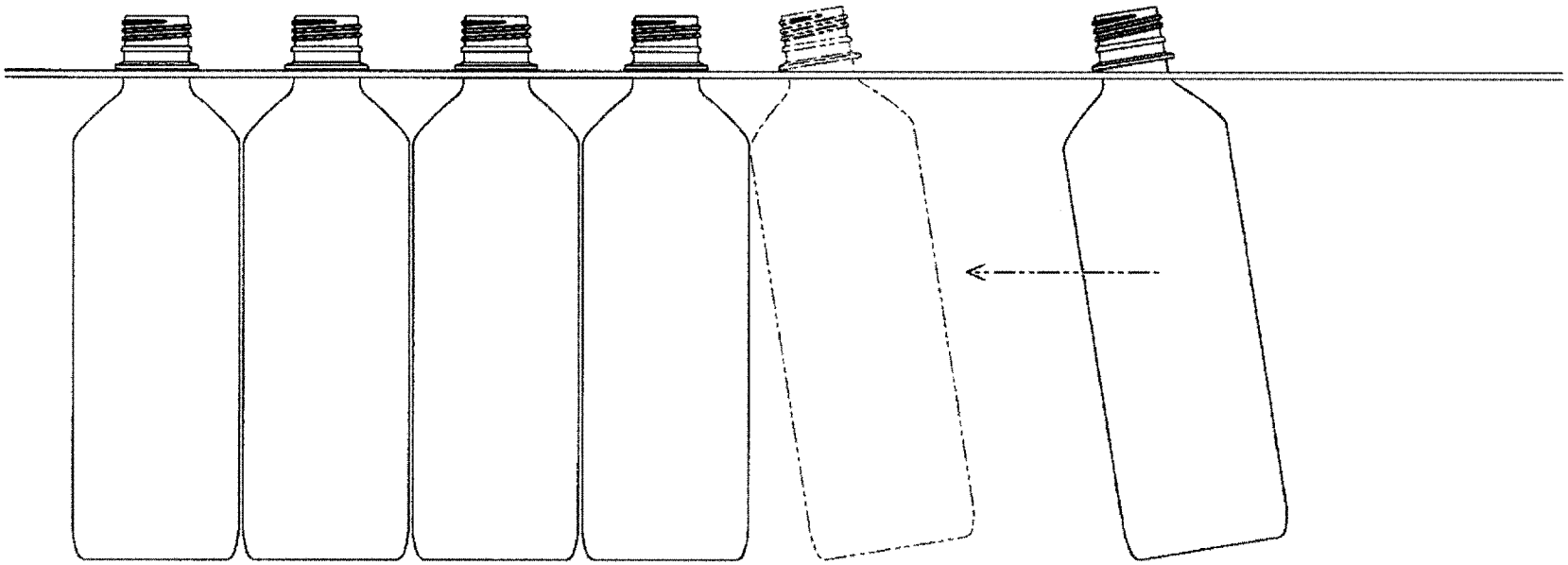
FIG. 13 is an explanatory diagram showing one example of a conveyance method of the container.

It should be noted that, as long as the site deformed by the load applied to the annular raised part 40 can be returned to the original shape by exerting sufficient restoring force, the longitudinal ribs 44 may be omitted when necessary (see FIG. 10, FIG. 11 and FIG. 12).

Moreover, the longitudinal ribs 44 are lined up along the extending direction of the annular raised part 40, whereby excessive deformation of the peripheral site connected to the annular raised part 40 can also be suppressed. A position of the other end of the longitudinal rib 44 can be appropriately set from such a viewpoint. In an example shown in FIGS. 8A and 8B, the longitudinal ribs 44 are lined up so as to be projected over the raised starting end $\alpha_2$ of the lower edge side first curved part 42*a* in the other end, but the longitudinal ribs 44 may be lined up so as to be housed within the lower edge side first curved part 42*a* in the other end, when necessary. The same description applies also to a case where the longitudinal ribs are lined up on the upper edge side of the annular raised part 40.

In order to suppress the excessive deformation of the peripheral site connected to the annular raised part 40, as in a modified example shown in FIG. 12, it is effectively also that horizontal ribs 45 are arranged in parallel along the extending direction of the annular raised part 40. When the longitudinal ribs 44 are omitted, such horizontal ribs 45 are provided, whereby the excessive deformation of the peripheral site connected to the annular raised part 40 can be suppressed.

A position in which the horizontal ribs 45 are provided and a shape thereof are appropriately set from a viewpoint of suppressing the excessive deformation of the peripheral site connected to the annular raised part 40. For example, the horizontal rib 45 is preferably provided as an arcuate annular groove having a curvature radius of 0.4 to 2 mm in the longitudinal section by overlapping with or coming close to the starting end in which the annular raised part 40 is raised from the peripheral surface of the barrel part 4, and a groove depth of the horizontal rib 45 at this time can be adjusted to 0.3 to 1.5 mm.

It should be noted that, in the modified example shown in FIG. 12, the horizontal rib 45 is provided by overlapping with a raised starting end d of the lower edge side first curved part 42*a*.

As described above, the present invention is described with reference to the preferable embodiments, but the present invention is not limited only to the embodiments described above, and the present invention can be obviously practiced with various modifications within the scope of the present invention.

For example, in the above-described embodiments, the present invention is described by illustrating the container 1 having the container shape called the round bottle, but an illustrated example only shows the preferable embodiment of the present invention, and the container shape to which the present invention is applied is not limited to the illustrated container. The present invention has technological features in the form of the shoulder part 3 in the synthetic resin container having the opening part 2, the shoulder part 3, the barrel part 4 and the bottom part 5, and a specific form of the site other than the shoulder part 3 can be appropriately changed when necessary.

More specifically, in the present invention, as long as the container 1 has the opening part 2, the shoulder part 3, the barrel part 4 and the bottom part 5, and the shoulder part 3 includes the hem part 30 which is curved in the convex arcuate shape toward the outside of the container in the longitudinal section, and is connected to the barrel part 4, and the plurality of groove parts 31 extending radially from the container-center side toward the outer-peripheral-edge side are formed in the shoulder part 3 so as to extend at least to the position that reaches the upper end edge UE30 of the hem part 30, a detailed configuration other than this configuration is not limited to the embodiments described above and can be appropriately changed. Moreover, the detailed configuration described in the embodiment described above can also be appropriately selected and combined.

The entire contents of the documents described in this description and the description of the Japanese application serving as a basis of claiming the priority concerning the present application to the Paris Convention are incorporated by reference herein.

Explanation of Numerical Symbols

1 Container
2 Opening part
3 Shoulder part
30 Hem part
31 Groove part
4 Barrel part
40 Annular raised part
41*a* Upper edge side first curved part
41*b* Upper edge side second curved part
42*a* Lower edge side first curved part
42*b* Lower edge side second curved part
43 Top surface part
43*a* Annular groove
44 Longitudinal rib
45 Horizontal rib
5 Bottom part
UE30 Hem part upper end edge

The invention claimed is:

1. A synthetic resin container, comprising
an opening part, a shoulder part, a barrel part and a bottom part,
wherein:
the shoulder part includes a hem part on a lower end side;
the hem part is curved in a convex arcuate shape toward an outside of the container in a longitudinal section, and is connected to the barrel part;
the shoulder part is formed in a truncated cone shape and is continued to the hem part while being diameter-expanded, and a position from which a longitudinal section of the shoulder part starts to be curved with the curvature radius of the convex arcuate shaped longitudinal section of the hem part is taken as an upper end edge of the hem part;
a plurality of groove parts extending radially from a container-center side toward an outer-peripheral-edge side are formed in the shoulder part; and
a terminating end of each groove part of the plurality of groove parts is located in a position projected over the upper end edge of the hem part, and is located in a range without passing over an outer-peripheral edge of the hem part.

2. The synthetic resin container according to claim 1, wherein a starting end of each groove part of the plurality of groove parts extends to an upper end edge of the shoulder part.

3. The synthetic resin container according to claim 1, wherein an angle formed between center lines of two groove parts adjacent to each other of the plurality of groove parts in a peripheral direction is 2.5° to 20°.

4. The synthetic resin container according to claim 1, wherein
the barrel part has an annular raised part extending along a peripheral direction,
an upper edge side of the annular raised part is raised through an upper edge side first curved part which is formed in a convex arcuate shape toward an inside of the container in a longitudinal section, and an upper edge side second curved part which is formed in a convex arcuate shape toward an outside of the container in the longitudinal section, and simultaneously
a lower edge side of the annular raised part is raised through a lower edge side first curved part which is formed in a convex arcuate shape toward an inside of the container in a longitudinal section, and a lower edge side second curved part which is formed in a convex arcuate shape toward an outside of the container in the longitudinal section.

5. The synthetic resin container according to claim 4, wherein the longitudinal sections of the upper edge side first curved part and the lower edge side first curved part each are formed in an arcuate shape having a curvature radius of 3 to 90 mm.

6. The synthetic resin container according to claim 4, wherein the longitudinal sections of the upper edge side second curved part and the lower edge side second curved part each are formed in an arcuate shape having a curvature radius of 3 to 90 mm.

7. The synthetic resin container according to claim 4, wherein a raised height ($H_1$) on the upper edge side of the annular raised part is 0.5 to 5% of a container barrel diameter ($D_1$) in a raised terminating end ($\gamma_1$) of the upper edge side second curved part.

8. The synthetic resin container according to claim 4, wherein a raised height ($H_2$) on the lower edge side of the annular raised part is 0.5 to 5% of a container barrel diameter ($D_2$) in a raised terminating end ($\gamma_2$) of the lower edge side second curved part.

9. The synthetic resin container according to claim 4, wherein a raised length ($L_1$) on the upper edge side of the annular raised part and a raised length ($L_2$) on the lower edge side of the annular raised part each are 3 to 18 mm.

10. The synthetic resin container according to claim 4, wherein the annular raised part includes a top surface part which is formed in a linear shape in a longitudinal section.

11. The synthetic resin container according to claim 10, wherein an annular groove is formed in the top surface part.

12. The synthetic resin container according to claim 4, wherein, on the lower edge side of the annular raised part, a plurality of longitudinal ribs, wherein one end thereof is projected into the lower edge side second curved part over a connected part of the lower edge side first curved part and the lower edge side second curved part, are lined up along an extending direction of the annular raised part.

13. The synthetic resin container according to claim 4, wherein, on the upper edge side of the annular raised part, a plurality of longitudinal ribs, wherein one end thereof is projected into the upper edge side second curved part over a connected part of the upper edge side first curved part and the upper edge side second curved part, are lined up along the extending direction of the annular raised part.

14. The synthetic resin container according to claim 4, wherein horizontal ribs are arranged in parallel along the extending direction of the annular raised part.

15. The synthetic resin container according to claim 4, wherein a longitudinal section shape of the barrel part is formed in a convex arcuate shape toward an inside of a container in a site connected to at least the annular raised part.

* * * * *